US010177449B2

(12) United States Patent
Ohlsson et al.

(10) Patent No.: US 10,177,449 B2
(45) Date of Patent: Jan. 8, 2019

(54) ANTENNA FRAME STRUCTURE

(71) Applicant: Huawei Technologies Co., Ltd., Shenzhen, Guangdong (CN)

(72) Inventors: Fredrik Ohlsson, Kista (SE); Hannes Huotelin, Kista (SE); Andrea Putaggio, Kista (SE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/686,351

(22) Filed: Aug. 25, 2017

(65) Prior Publication Data

US 2017/0373387 A1 Dec. 28, 2017

Related U.S. Application Data

(63) Continuation of application No. PCT/EP2015/054063, filed on Feb. 26, 2015.

(51) Int. Cl.
*H01Q 1/02* (2006.01)
*H01Q 1/12* (2006.01)
*H01Q 1/42* (2006.01)

(52) U.S. Cl.
CPC ..... *H01Q 1/42* (2013.01); *H01Q 1/02* (2013.01); *H01Q 1/1207* (2013.01)

(58) Field of Classification Search
CPC ..... H01Q 1/42; H01Q 1/1207; H01Q 1/02
USPC ..... 343/702, 872
See application file for complete search history.

(56) References Cited

U.S. PATENT DOCUMENTS

| | | | | |
|---|---|---|---|---|
| 4,783,666 | A | 11/1988 | Ast et al. | |
| 2013/0222201 | A1 | 8/2013 | Ma et al. | |
| 2013/0321989 | A1 | 12/2013 | Uesugi et al. | |
| 2016/0344095 | A1* | 11/2016 | Tagi | H01Q 1/3233 |

FOREIGN PATENT DOCUMENTS

WO 98/57311 A2 12/1998

* cited by examiner

*Primary Examiner* — Khai M Nguyen

(57) ABSTRACT

A radome assembly includes a radome member, a heat sink member, a seal member disposed between the radome member and the heat sink member, and a frame assembly configured to compress the seal member between the radome member and the heat sink member. The frame assembly includes a fixation member configured to be fixedly engaged with the heat sink member and an arm member, the arm member configured to engage the radome member to compress the seal member between the radome member and the heat sink member when the fixation member is engaged with the heat sink member, and wherein engagement of the fixation member with the heat sink member in a compressed state of the seal member forms a gap between the radome member and the heat sink member.

15 Claims, 16 Drawing Sheets

ANTENNA FRAME STRUCTURE

CROSS-REFERENCE TO RELATED APPLICATIONS

This application is a continuation of International Application No. PCT/EP2015/054063, filed on Feb. 26, 2015, the disclosure of which is hereby incorporated by reference in its entirety.

TECHNICAL FIELD

Aspects of the present application relate generally to enclosures for antennas of wireless communication systems and in particular to an enclosure for a base station antenna assembly of a wireless communication system.

BACKGROUND

With the proliferation of wireless communication and mobile radio stations, the base station(s) (BS) for such systems can be located in more populated and public areas, such as city centers. As such, the industrial and aesthetic design aspects of such base stations, including the enclosure for the antenna structures, becomes a more important feature.

A radome is generally understood to be a weatherproof enclosure for an antenna system. As is generally understood, the radome houses the antenna assembly and structure for the base station of the mobile radio system. One common configuration of a radome is a generally round or spherical shape. However, with the different designs and requirements for antennas and the radomes for such antennas, there are requirements for flat surfaces or front faces, rather than the more common spherical design.

The material for a radome is generally plastic, to provide communication transparency for antenna signals. The backside of the base station antenna structure, also referred to as a heatsink, is generally manufactured from a thermally conductive material, such as die cast aluminum. The heatsink will include cooling ribs, which are used for passive cooling of the antenna heat generating elements.

The radome is typically coupled to the heatsink in a secure manner. Normally, the radome is coupled to the heatsink using fixation devices and fasteners such as screws. There is also normally a water proof gasket between the radome and the heatsink. When the radome is fixed to the heatsink, the structure is generally stiff or rigid.

The plastic radome and aluminum heatsink parts or components for a base station antenna are typically designed so that in a normal or ambient temperature environment, the different parts fit together in a reliable and secure manner. However, plastic and aluminum parts typically have different thermal expansion characteristics. Thus, when the temperature of the environment in which the base station antenna system is located changes, there can be expansion and contraction of the plastic and aluminum parts. Due to the different thermal expansion characteristics of the plastic and aluminum parts, these parts can expand and contract differently. This can result in problems with the fit of the different parts as well as the integrity of the radome structure.

Referring to FIGS. 1A and 1B, one phenomenon that can occur when there are temperature changes, is what is referred to as a "swelling" of the different materials. As shown in FIG. 1A, the radome 10 and the heatsink 20 are fixed together by fixing points 12, which can be screws. A gasket 14 is provided between the radome 10 and heatsink 20. FIG. 1A illustrates the radome and heatsink structure in a normal or ambient temperature environment.

In the example of FIG. 1B, there has been a temperature change. In this case, the temperature has risen resulting in expansion of the different radome 10 and the heatsink 20. However, since the plastic radome 10 expands faster or to a greater degree than the aluminum heatsink 20, the originally flat surface shape of the plastic radome 10 takes on a "curved" or rounded shape or form.

A change in the shape of the radome can be undesirable. The radiation from antenna elements will be impacted if the distance from the antenna element to the radome changes. Also, if the radome develops a curved shape, this can be noticeable when the original shape of the radome was planar or flat.

Also, the different degrees of expansion can also result in structural problems. The bending of the plastic radome relative to the aluminum heatsink can place stresses on the various parts including the fixation points. These stresses can affect the integrity of the radome structure as well as the waterproofness of the structure. It would be advantageous to provide a mechanical structure for base station antenna enclosure that accommodates thermal expansion while maintaining a shape, waterproofness and aesthetic design considerations of the radome.

Accordingly, it would be desirable to provide an antenna housing structure that addresses at least some of the problems identified above.

SUMMARY

In various embodiments, there is provided a radome structure for an antenna assembly that has a substantially flat outer surface, a radome structure that maintains a substantially flat outer surface when subject to thermal expansion, an antenna structure that accommodates thermal expansion of the different materials including the radome structure while maintaining the aesthetic design characteristics and waterproofness of the radome structure.

According to a first aspect, there is provided a radome assembly that includes a radome member, a heat sink member, a seal member disposed between the radome member and the heat sink member, and a frame assembly configured to compress the seal member between the radome member and the heat sink member. In one embodiment, wherein the frame assembly includes a fixation member configured to be fixedly engaged with the heat sink member and an arm member, the arm member configured to engage the radome member to compress the seal member between the radome member and the heat sink member when the fixation member is engaged with the heat sink member, and wherein engagement of the fixation member with the heat sink member in a compressed state of the seal member forms a gap between the radome member and the heat sink member. The gap advantageously accommodates expansion of the radome member, particularly in the horizontal direction. Since the radome member is not fixed to the heat sink member, when the radome member is subject to thermal expansion, the radome member can move horizontally, sliding over the seal member. The shape of the radome member is advantageously retained, and the seal retains its compressed state to keep the radome enclosure waterproof.

In a first possible implementation form of the radome assembly according to the first aspect, the radome member has a flat outer surface. A flat or substantially flat outer surface for a radome assembly, rather than a round or spherical shape, is desirable in certain applications and implementations In a second possible implementation form of the radome assembly according to the first aspect, the radome member is disposed between the arm member of the frame assembly and the heat sink member in the compressed state of the seal member. According to the disclosed embodiments, the radome member is not affixed to the heat sink member. This allows the radome member to move or expand independently and at a different rate relative to the heat sink member.

In a third possible implementation form of the radome assembly according to the first aspect, the fixation member includes a threaded portion. According to the disclosed embodiments, the frame assembly is attached to the heat sink. A fixation member can receive a fastener to secure the frame assembly to the heat sink. The threaded portion allows for a fastener, such as screw to be used to secure the frame assembly to the heat sink.

In a fourth implementation form of the radome assembly according to the third possible implementation form of the first aspect, the threaded portion of the fixation member comprises a threaded insert. The use of an insert reduces the stresses on the frame assembly itself. The insert can also be used to establish a size of the gap.

In a fifth possible implementation form of the radome assembly according to the first aspect, a lowermost position of the fixation member relative to a lowermost position of the arm member defines a spacing of the gap between the radome member and the heat sink member in the compressed state of the seal member. It is important to ensure that the gasket is compressed sufficiently to provide the required waterproofness. The gap spacing is also important in order to accommodate thermal expansion of the radome member. Differences in the lowermost positions of the fixation member and the arm member define a gap sufficient to compress the seal member and allow for horizontal movement of the radome member during thermal expansion.

In a sixth possible implementation form of the radome assembly according to the first aspect, a fastener member extends through an opening in the heat sink member and is received in the fixation member to secure the frame assembly to the heat sink member and compress the seal member. The use of a fastener such as a screw provides a simple way to secure the frame assembly to the heat sink and compress the seal member sufficiently.

In a seventh possible implementation form of the radome assembly according to the first aspect, the fixation member is disposed parallel to the arm member. The arrangement of the fixation member relative to the arm member forms a channel that covers the connection of the frame assembly to the heat sink and edge of the radome member. The alignment also provides a defined degree of compressive force for compressing the seal between the radome member and the heat sink member.

In an eighth possible implementation form of the radome assembly according to the first aspect, the fixation member includes a support sleeve, and at least one support pin adjacent to the support sleeve, wherein the fastener member is received in the support sleeve to secure the frame assembly to the heat sink member and compress the seal member. The use of support pins requires less space since the support is not located around the screw. This allows the frame to be thinner.

In a ninth possible implementation form of the radome assembly according to the first aspect, the at least one support pin comprises a pair of support pins and the support sleeve is disposed between the pair of support pins. A pair of support pins rather than just one provides additional support that is more evenly distributed.

In a tenth possible implementation form of the radome assembly according to the first aspect, a lowermost position of the at least one support pin relative to a lowermost position of the arm member limits a compression of the seal member between the radome member and the heat sink member and defines a spacing of the gap between the radome member and the heat sink member. It is important to ensure that the gasket is compressed sufficiently to provide the required waterproofness. The gap spacing is also important in order to accommodate thermal expansion of the radome member. Differences in the lowermost positions of the support pin and the arm member define a gap sufficient to compress the seal member and allow for horizontal movement of the radome member during thermal expansion.

In an eleventh possible implementation form of the radome assembly according to the first aspect, the radome member comprises a lip member, the lip member compressing the seal member against the heat sink member. The lip member provides a surface that can be used to compress seal member between the radome member and the heat sink member.

In a twelfth possible implementation form of the radome assembly according to the first aspect, the lip member is disposed parallel to the radome member. In one embodiment, the top surface of the radome member is planar or flat. The orientation of the lip member relative to the top surface assists in the translation of the horizontal movement of the radome member due to thermal expansion, provides a surface area to compress the seal member against the heat sink member and allows for movement of the lip member over the seal member during thermal expansion.

In a thirteenth possible implementation form of the radome assembly according to the first aspect, the heat sink member comprises a channel member, the seal member being at least partially received in the channel member. The channel member provides for retention of the seal member during compression and movement of the radome member. The radome member, and in particular the lip member, can slide or move horizontally over the seal member, when the seal member is in the compressed state. The channel will retain the seal member.

In a fourteenth possible implementation form of the radome assembly according to the first aspect, the radome member does not contact the heat sink member in the compressed state of the seal member. During thermal expansion, the plastic radome member will expand at a faster rate than the heat sink member. Since the radome member is not in contact with, or affixed to the heat sink, the plastic radome member can move independently. This reduces the potential for any "swelling" or curving of the radome member to occur.

In a fifteenth possible implementation form of the radome assembly according to the first aspect, the gap between the radome member and the heat sink member accommodates thermal expansion of the radome member relative to the heat sink member to maintain a form of the radome member. The aspects of the disclosed embodiments allow the radome member to move relative to the heat sink member, while still maintaining a waterproof seal between the radome member and the heat sink member. The gap is sufficient to allow for thermal expansion or horizontal movement of the radome member.

These and other aspects, implementation forms, and advantages of the exemplary embodiments will become apparent from the embodiments described herein considered in conjunction with the accompanying drawings. It is to be understood, however, that the description and drawings are designed solely for purposes of illustration and not as a definition of the limits of the disclosed subject matter, for which reference should be made to the appended claims. Additional aspects and advantages of the disclosure will be set forth in the description that follows, and in part will be obvious from the description, or may be learned by practice. Moreover, the aspects and advantages of the disclosure may be realized and obtained by means of the instrumentalities and combinations particularly pointed out in the appended claims.

BRIEF DESCRIPTION OF THE DRAWINGS

In the following detailed portion of the present disclosure, the invention will be explained in more detail with reference to the example embodiments shown in the drawings, in which.

DETAILED DESCRIPTION

The aspects of the disclosed embodiments are directed to a housing structure or enclosure for an antenna assembly of a base station in a wireless communication system. In one embodiment, the surface shape of the enclosure, also referred to herein as a radome structure or assembly, is substantially planar or flat. This is in contrast to the spherical or round shape of a typical radome structure. Through the use of a frame assembly that compresses the seal between the plastic radome member and the thermally conductive heat sink, the aspects of the disclosed embodiments advantageously allow for expansion of the plastic radome of the enclosure relative to the heat sink. By accommodating horizontal movement due to thermal expansion, the surface shape of the plastic radome member and the integrity of the mechanical housing structure are not compromised.

Figure 1B:
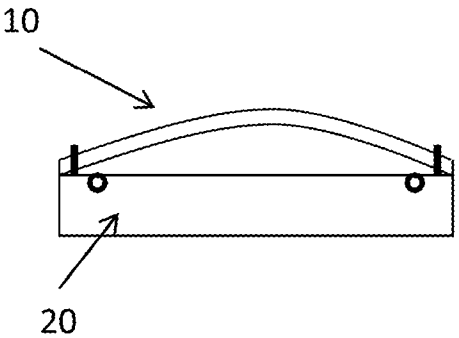
FIGS. 1A and 1B illustrate a fixed radome structure in the prior art.
Figure 1A:
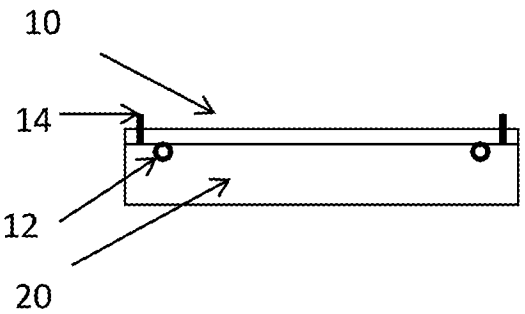
Figure 2:
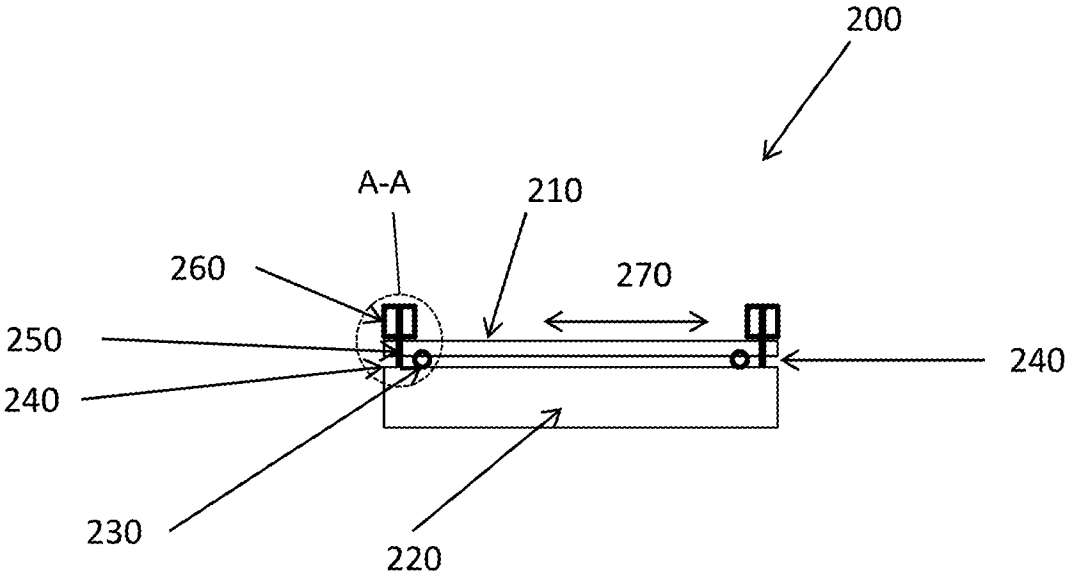
FIG. 2 illustrates a schematic view of one embodiment of a radome assembly incorporating aspects of the present disclosure.

FIG. 2 illustrates one embodiment of a mechanical structure for a radome assembly 200 incorporating aspects of the present disclosure. The radome assembly 200 is a substantially flat structure which provides for mechanical expansion, while at the same time maintaining structural integrity, waterproofness, and aesthetic design features.

Figure 7:
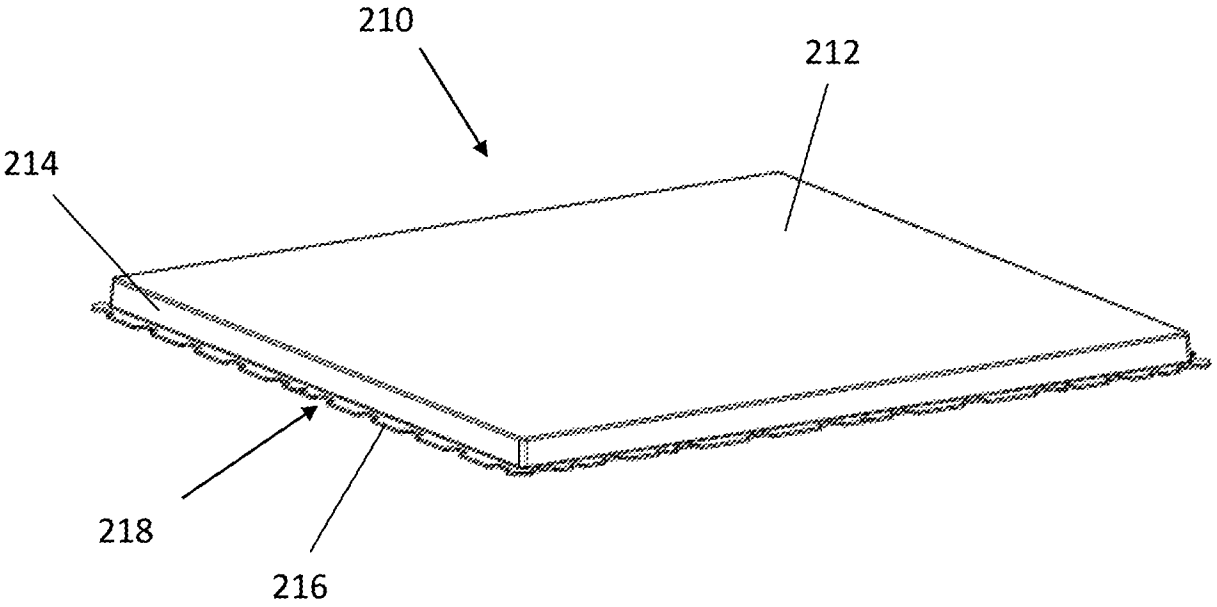
FIG. 7 is a top perspective view of an exemplary radome member for a radome assembly incorporating aspects of the present disclosure.

As is illustrated in FIG. 2, the radome assembly 200 includes a radome member 210 and a heatsink member 220. The radome member 210 generally comprises a plastic material that enables the transmission of signals to and from the antenna assembly (not shown) housed within the radome assembly 200, without significant signal attenuation. The plastic material of the radome must also protect the antenna elements and electronics from the elements, such as water. In alternate embodiments, the material of the radome member 210 can comprise any suitable material that protects the antenna elements and electronics and enables communication signal propagation without significant or noticeable signal attenuation. FIG. 7 illustrates an exemplary radome member 210.

In the example of FIG. 7, the top or outer surface 212 of the radome member 210 is planar or flat. It will be understood that the terms "planar" and "flat" are relative terms and that the top surface 212 of the radome member can be substantially planar or flat. The radome member 210 includes side members 214 that extend downwards from the top surface 212. In one embodiment, the side members 214 extend perpendicularly from the top surface 212. Alternatively, the side members 214 can extend at any suitable angle that is greater than 0 degrees but less than 90 degrees relative to the top surface 212.

As shown in FIG. 7, a lip member 216 extends outward from the side member 214. In one embodiment, the lip member 216 is used to secure the radome member 210 in the radome assembly 200. The lip member 216 is generally disposed perpendicular to the side member 214. In alternative embodiments, the lip member 216 can be disposed at any suitable angle relative to the side member 214 that is greater than 0 degrees and less than 90 degrees. In one embodiment, the lip member 216 is disposed substantially parallel to the top surface 212.

In the exemplary embodiment of FIG. 7, the lip member 216 includes recesses or openings 218, which can also be referred to as cutouts. The recesses 218 are generally configured to receive or accommodate portions of the frame assembly 260, as will be described further below.

As is illustrated in the example of FIG. 7, the general shape of the radome member 210 is substantially square or rectangular and the outer surface 212 substantially flat or planar. In alternate embodiments, the shape of the radome member 210 can comprises any suitable geometric shape, such as round or triangular.

Figure 8:
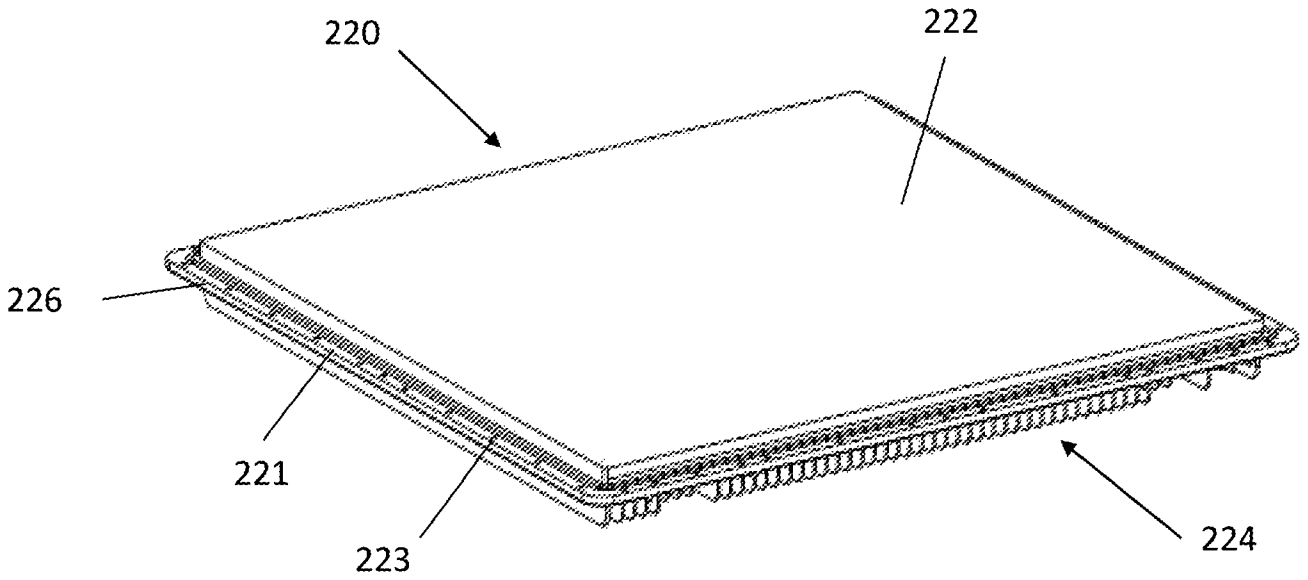
FIG. 8 is a top perspective view of an exemplary heat sink member for a radome assembly incorporating aspects of the present disclosure.

Referring again to FIG. 2, the heat sink member 220 is generally configured to be thermally coupled to the antenna assembly (not shown). The heat sink member 220 acts as the main mechanical structure to which the antenna elements and heat generating electronics are fixed or secured. In one embodiment, the heat sink member 220 comprises a metal or aluminum material. In alternate embodiments, the heat sink member 220 comprises any suitable thermally conductive material. FIG. 8 illustrates an exemplary heat sink member 220.

In the example of FIG. 8, the heat sink member 220 has a substantially flat or planar top surface 222. The bottom surface 224 in this example includes fins. The overall shape or geometry of the heat sink member 220 of FIG. 8 is substantially square or rectangular. However, in alternate embodiments, the shape of the heat sink member 220 can comprise any suitable geometric shape, such as round or triangular.

The heat sink member 220 of FIG. 8 includes a lip member 226. The lip member 226 in this example is substantially flat and aligned substantially parallel to the top surface 222 of the heat sink member 220. In alternate embodiments, the shape and orientation of the lip member 226 can include any suitable shape and orientation.

As shown in FIG. 8, in one embodiment, the lip member 226 includes holes or openings 223. As will be described further herein, the openings 223 are configured to receive fasteners, such as fastener 252 shown in FIG. 5, which will be used to secure the heat sink member 220 to the frame assembly 260. In one embodiment, the openings 223 comprise circular holes in the lip member 226 of the heat sink member 220.

Figure 3:
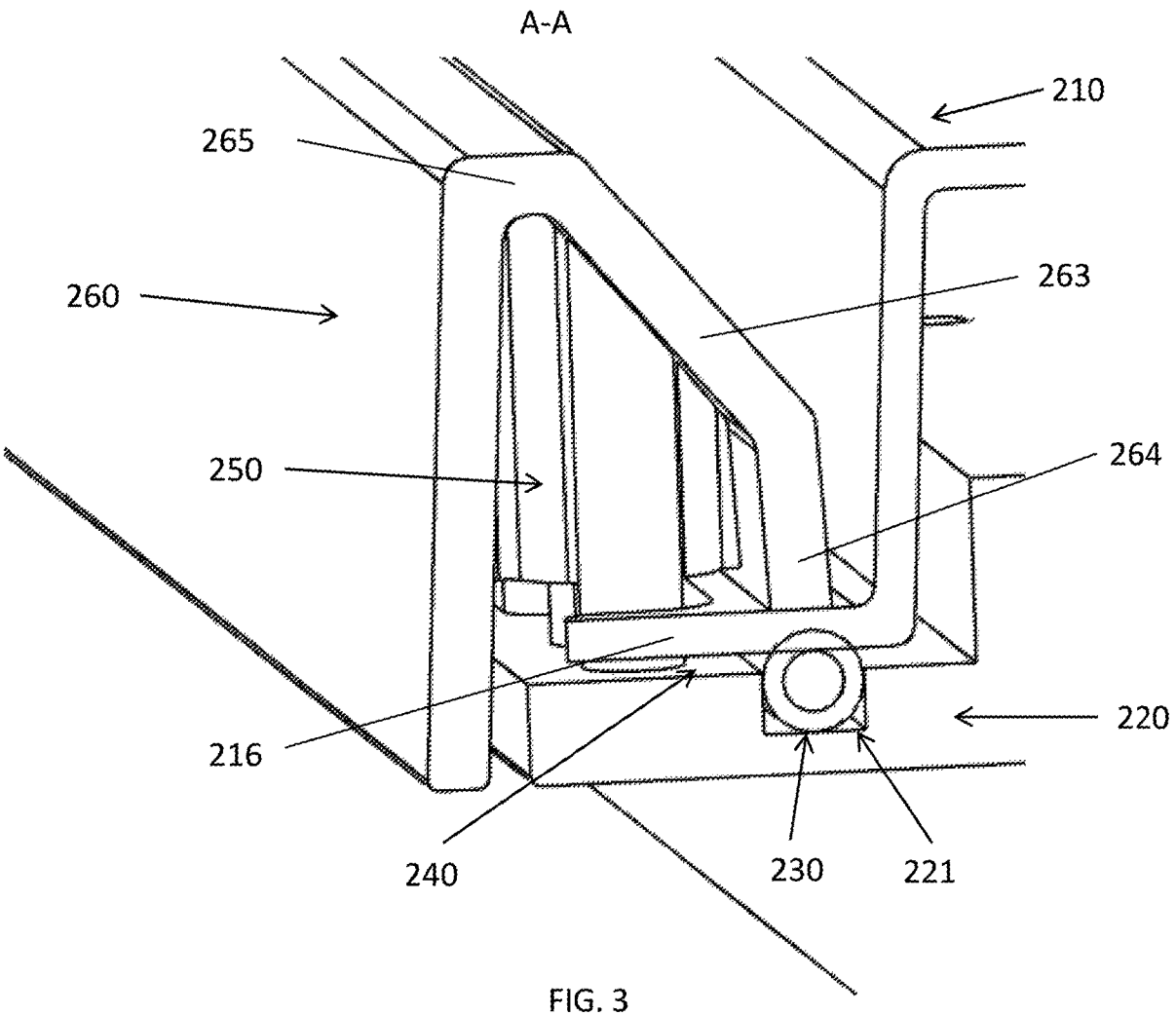
FIG. 3 illustrates a detail corner view A-A of one embodiment of the radome assembly of FIG. 1.

Referring to FIGS. 3 and 8, in one embodiment, the lip member 226 includes a channel portion 221. The channel portion 221 is generally configured to receive or hold the sealing member 230.

Figure 9:
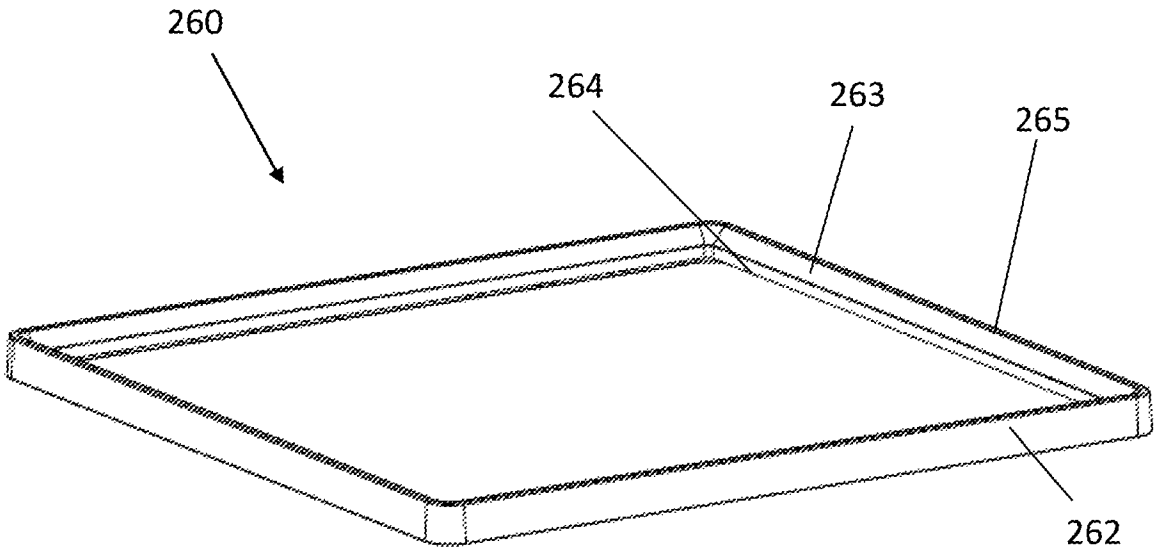
FIG. 9 illustrates an exemplary frame member for a radome assembly incorporating aspects of the present disclosure.

In the embodiment illustrated in FIG. 2, the radome member 210 is not coupled directly to the heat sink member 220. As shown for example in FIGS. 2 and 3, the frame assembly 260 is used to couple or secure the radome member 210 to the heatsink member 220. The radome member 210 is disposed between the frame assembly 260 and the heatsink member 220. FIG. 9 illustrates one embodiment of an exemplary frame member 260.

In the example of FIG. 9, the shape of the frame assembly 260 is substantially square or rectangular. The shape of the frame assembly 260 will generally correspond to the shape of the radome member 210. In alternate embodiments, the shape of the frame assembly 260 can comprises any suitable shape. In one embodiment, the outer dimensions of the frame assembly are approximately 629 millimeters by 629 millimeters. In alternate embodiment, the frame assembly 260 can comprise any suitable size. Generally, the outer dimensions of the frame assembly 260 will be larger than the outer dimensions of the radome member 210 so that the frame assembly 260 can be disposed around and over the radome member 210.

As is shown in examples of FIGS. 3 and 9, the frame assembly 260 includes outer side member 262 and an inner side member 264. The members 262 and 264 form a section assembly that is used to secure the radome member 210 to the heat sink member 220, as well as provide a cover around the outer edges of the radome assembly 200. In one embodiment, this section assembly can be referred to as a channel. As will be described further herein, the arm member 264 engages the lip member 216 of the radome member 210 to compress the seal member 230 between the radome member 210 and heat sink member 220. The outer side member 262 conceals the sides of the radome member 210 and the heat sink member 220 from view.

In the example shown in FIGS. 3 and 9, the outer side member 262 is disposed substantially parallel relative to the inner side member 264. In alternate embodiments, the outer side member 262 and the inner side member 264 can be arranged any suitable relationship that allows for the inner side member 264 to compress the seal member 230 between the radome member 210 and the heat sink member 220 and the outer side member 262 to cover the sides of the radome assembly 220, as is generally described herein.

In the example shown in FIGS. 3 and 9, a connecting member 263 couples or joins the outer side member 262 and the inner member 264. In this embodiment, the connecting member 262 is substantially straight and angled relative to the outer side member 262 and the inner member 264. In alternate embodiments, the shape of the connecting member 262 can be any suitable shape, such as curved, for example.

The general shape of the section assembly formed by the outer side member 262, connecting member 263 and inner member 264 in this example is substantially triangular. In alternate embodiments, the shape of the section assembly formed by members 262, 263 and 264 can be any suitable shape, such as square, rectangular or semi-circular. Although the examples are described herein with respect to a connecting member 263, in one embodiment, the members 263 and 264 comprise single piece or member.

The frame assembly 260 is configured to be disposed over and around the lip member 216 of the radome member 210. As is shown in FIG. 3, in one embodiment, the inner member 264 is disposed on top of or in contact with the lip member 226 while the outer side member 262 extends over the outer edges of the radome member 210 and the heat sink member 220.

Figure 10:
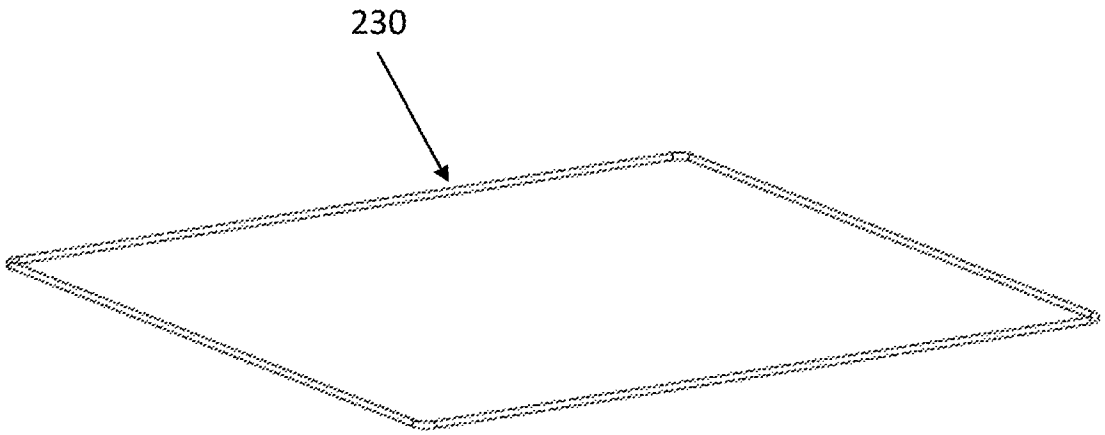
FIG. 10 illustrates an exemplary seal member for a radome assembly incorporating aspects of the present disclosure.
Figure 11:
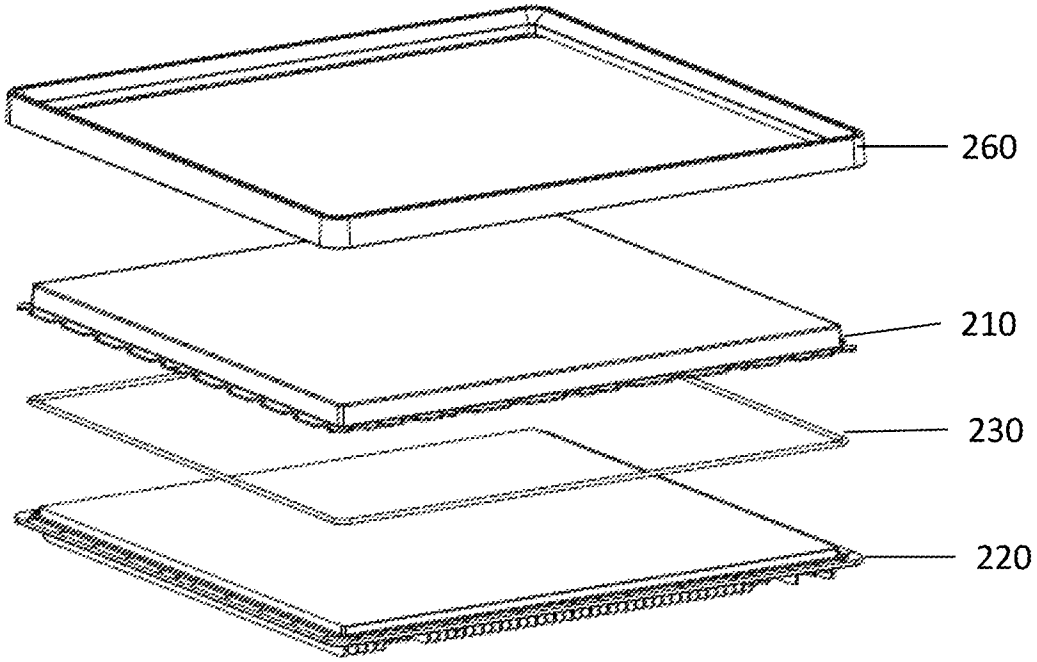
FIG. 11 illustrates an assembly diagram for a radome assembly incorporating aspects of the present disclosure.

In one embodiment, the radome assembly 200 is configured to be water tight. The seal or sealing member 230, which in one embodiment comprises a gasket, is configured to be compressed between the radome member 210 and the heat sink member 220. The sealing member 230 is received in the channel 221 of the heat sink member 220. The outer dimensions and geometry of the sealing member 230 generally follow that of the heat sink member 220 and frame assembly 260. In one embodiment, a section shape of the sealing member 230 is substantially circular. In alternate embodiments, any suitably shaped sealing member can be used that prevents water from entering the radome assembly 200. FIG. 10 illustrates an exemplary sealing member 230.

As noted above, during thermal expansion, the plastic radome member 210 will expand. Referring again to FIG. 3, in order to accommodate the sideways or horizontal movement of the radome member 210 during thermal expansion, the aspects of the disclosed embodiments provide a gap 240 between the radome member 210 and the heat sink member 220 when the sealing member 230 is in a compressed state between the radome member 210 and the heat sink member 220. The gap 240 must be well defined to provide the clearance needed for the sideways movement of the radome member 210 during thermal expansion and define the compression of the sealing member 230.

Referring to FIGS. 2 and 3, for example, the gap 240 between the radome member 210 and the heat sink member 220 allows for expansion of the radome member 210 in the horizontal direction, as is illustrated by arrow 270. The spacing of the gap 240 is defined by the attachment of the frame assembly 260 to the heat sink member 220, with the radome member 210 therebetween.

Referring to FIG. 3, in one embodiment, a fixation member 250 is used to couple the frame assembly 260 to the heat sink member 220. In one embodiment, referring to FIGS. 5 and 14, for example, a fastener member 280 is inserted into the fixation member 250 to secure the frame assembly 260 to the heat sink member 220. As shown in FIG. 3, when the fixation member 250 is secured with the fastener member the inner member 264 of the frame assembly 260 presses against the lip member 216 of the radome member 210. The seal member 230 is compressed between the radome member 210 and the heat sink member 220 to provide a water tight seal between the radome member 210 and the heat sink member 220. The gap 240 is defined in the compressed state of the seal member 230.

As will be described further herein, the fixation member 250 is configured to limit the compression of the seal member 230 and to define the gap 240. The gap 240 enables horizontal or sideways movement or expansion of the radome member 210. Thus, during thermal expansion of the radome member 210, the outer surface 212 of the radome member 210 will remain substantially the same shape, such as flat.

In one embodiment, a dimension of the gap 240 is in the range of approximately 0.5 millimeters to and including 1.0 millimeters. In alternate embodiments, the dimension of the gap 240 can be any suitable size so long as the sealing member 230 is compressed sufficiently between the radome member 210 and the heat sink member 220 to provide a water tight seal.

Figure 4:
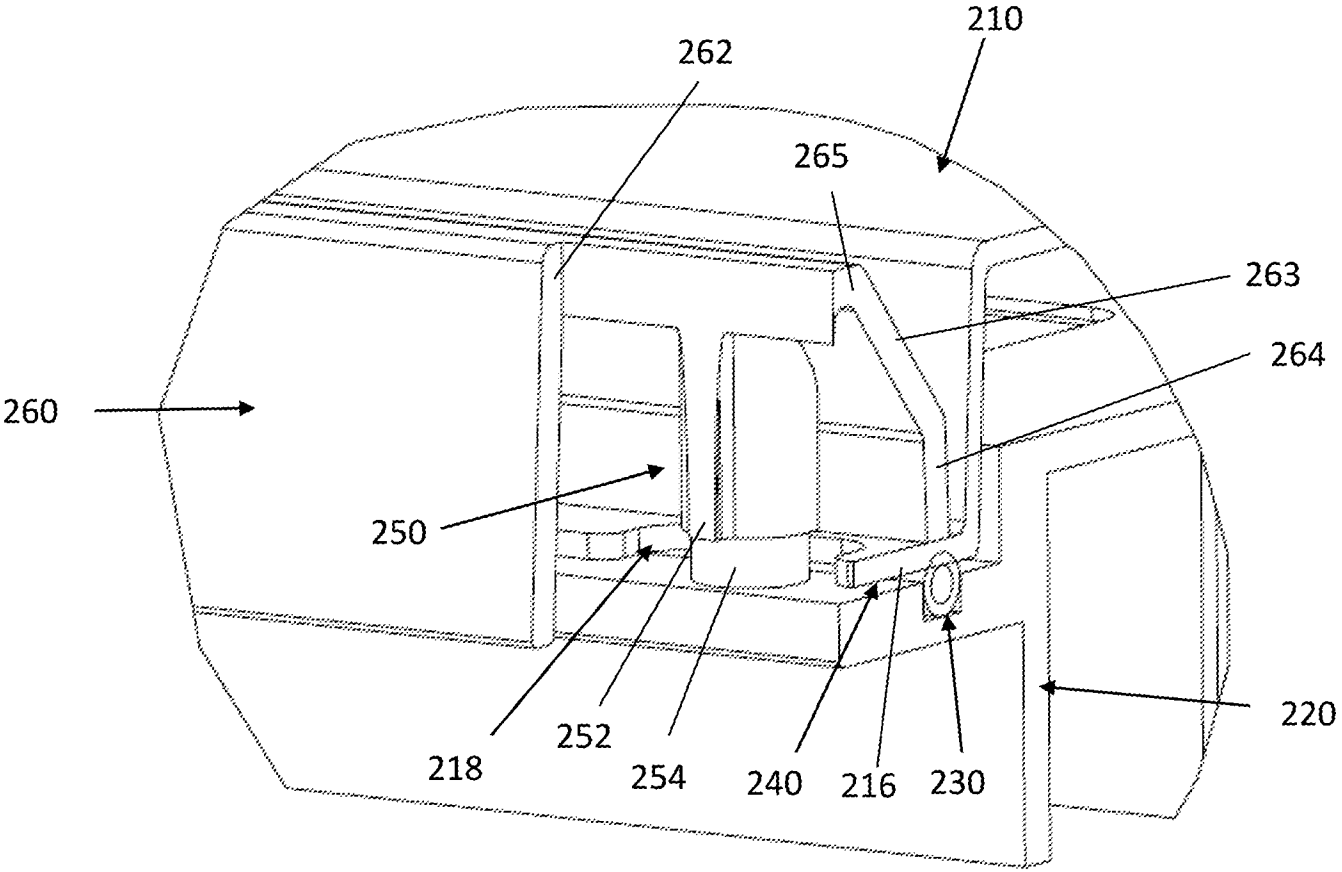
FIG. 4 illustrates a partial cutaway view of one embodiment of a frame member for a radome assembly incorporating aspects of the present disclosure.

Referring to FIG. 4, one embodiment of a fixation member 250 for a radome assembly 200 incorporating aspects of the disclosed embodiments is illustrated. In this example, the fixation member 250 comprises a support sleeve member 252. The support sleeve member 252 is configured to engage the heat sink member 220 in a compressed state of the seal member 230. As shown in FIG. 4, the support sleeve member 252 is accommodated in the opening 218 of the lip member 216 of the radome member 210.

In the example of FIG. 4, the support sleeve member 252 is shown as being substantially cylindrical in shape. In alternate embodiments, the support sleeve member 252 can comprise any suitable shape, other than including cylindrical.

Figure 5:
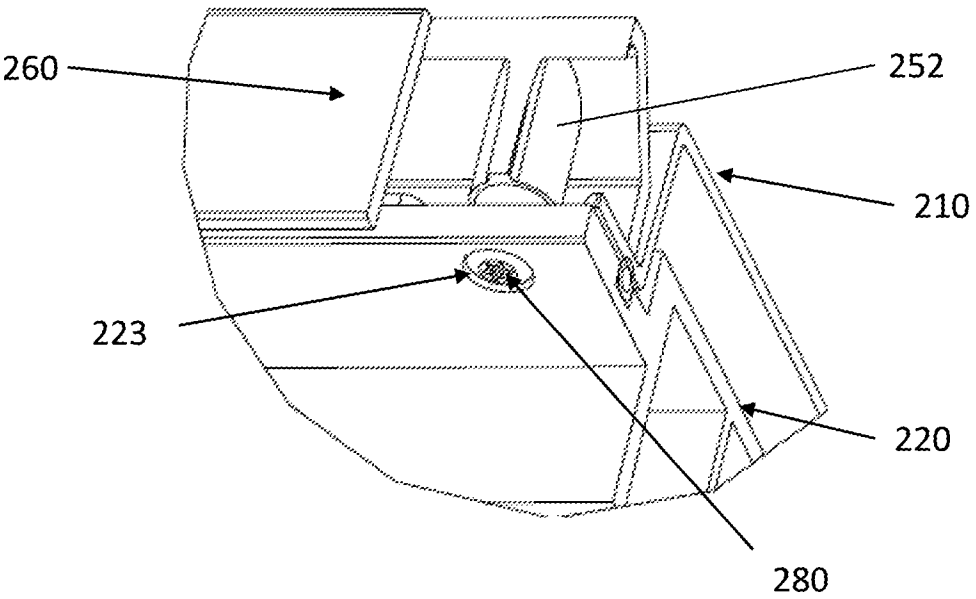
FIG. 5 illustrates a partial bottom view of the radome assembly of FIG. 4.

As shown in FIG. 5, a fastener member 280 can be inserted in the opening 223 of the heat sink member 220. The fastener member 280 is received by the support sleeve member 252 and is used to secure the support sleeve member 252 and frame assembly 260 to the heat sink member 220. In the embodiment where the fastener member 280 is a screw, the support sleeve member 252 is threaded.

Figure 6:
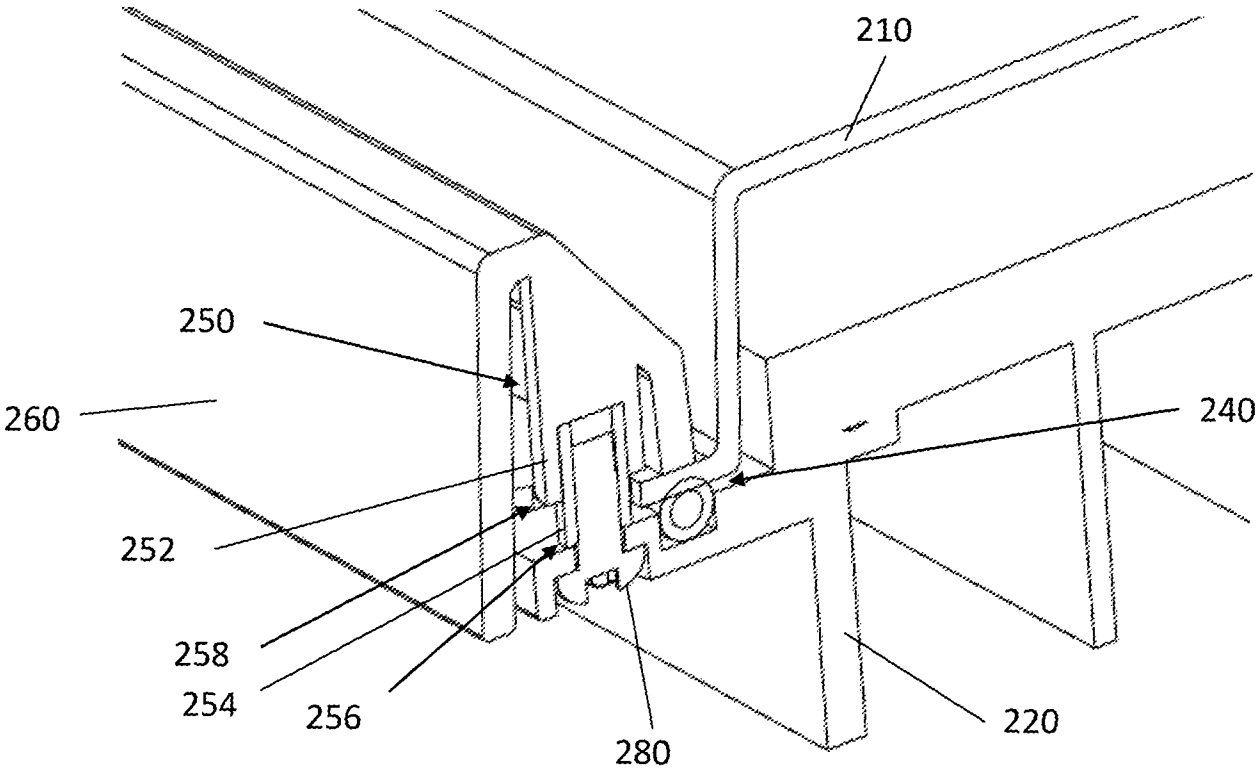
FIG. 6 illustrates a cross-sectional view of a fixation member for one embodiment of a radome assembly incorporating aspects of the present disclosure.

In one embodiment, referring to FIG. 6, the support sleeve member 252 can include or comprise a threaded insert 254. The threaded insert 254 is configured to define a distance of the gap 240 when the end 256 of the end portion 256 of the threaded insert 254 presses against a surface of the heat sink member 220.

The support sleeve member 252 is configured to provide support around the threaded insert 254. In the example shown in FIG. 6, the threaded insert 254 extends beyond an end portion 258 of the support sleeve member 252 and an end portion 256 of the threaded insert 254 is in contact with the heat sink member 220 in the compressed state of the seal member 230. By having the threaded insert 254 contact the heat sink member 220, the risk that the threaded insert 254 is pulled out from the fixation member 250 when the screw 280 is tightened is minimized. If there is a gap between the threaded insert 254 and the heat sink member 220, there will be a "pull-out" force on the threaded insert 254 from the screw 280. Although the support sleeve 252 is shown as not making contact with the heat sink member 220 in the example of FIG. 6, in alternate embodiments, the support sleeve 252 can extend along the length of the threaded insert 254.

In one embodiment, the support sleeve member 252 and the frame assembly 260 comprise a plastic material. In this example, the threaded insert 254 can comprise a metal insert that can be pressed, molded or bonded into the plastic support sleeve member 252. By using a metal threaded insert 254, the risk of overtightening and damaging plastic threads is minimized.

For example, the dimensions of the threaded insert 254 are such that the compression of the sealing member 230, by the pressing of the inner member 264 against the radome member 210, is limited when the fastener 280 is secured within the threaded insert 254 of the support sleeve member 252. Since the support sleeve member 252 is in contact with the heat sink member 220, this contact provides a mechanical stop and defines the gap 240 between the radome member 210 and the heat sink member 220. This embodiment is advantageous in that the mechanical stop provided by the threaded insert 254 can reduce stresses on the fixation member 250 when the fastener member 280 is tightened and secured.

With reference to FIG. 4, in a compressed state of the seal member 230, the sleeve member 252 is in physical contact with the heat sink member 220 and the inner arm member 264 of the frame assembly 260 is pressing against the lip member 216 of the radome member 210. The radome member 210 does not come into physical contact with the heat sink member 220. The space between the radome member 210 and the heat sink member 220 is defined by the gap 240.

The gap 240 accommodates thermal expansion of the radome member 210 relative to the heat sink member 220 to maintain the shape of the radome member 210. This is especially useful when the outer surface 212 of the radome member 210 is flat. As was noted, the plastic material of the radome member 210 expands at a higher rate than the thermally conductive material of the heat sink 220. In accordance with the aspects of the disclosed embodiments, as the radome member 210 expands, the gap 240 will accommodate the horizontal expansion.

In one embodiment, as the radome member 210 expands in a compressed state of the seal member 230, the radome member 210, and in particular the lip member 216, will slide over the seal member 230 in the direction 270 shown in FIG. 2. This allows the radome assembly 200 to maintain the integrity of the waterproof seal provided by the compressed state of the seal member 230. The accommodation of the horizontal expansion of the radome member 210 by the gap 240 alleviates any "swelling" that may otherwise be realized and generally maintains the surface shape of the outer surface 212 of the radome member 210.

Figure 12:
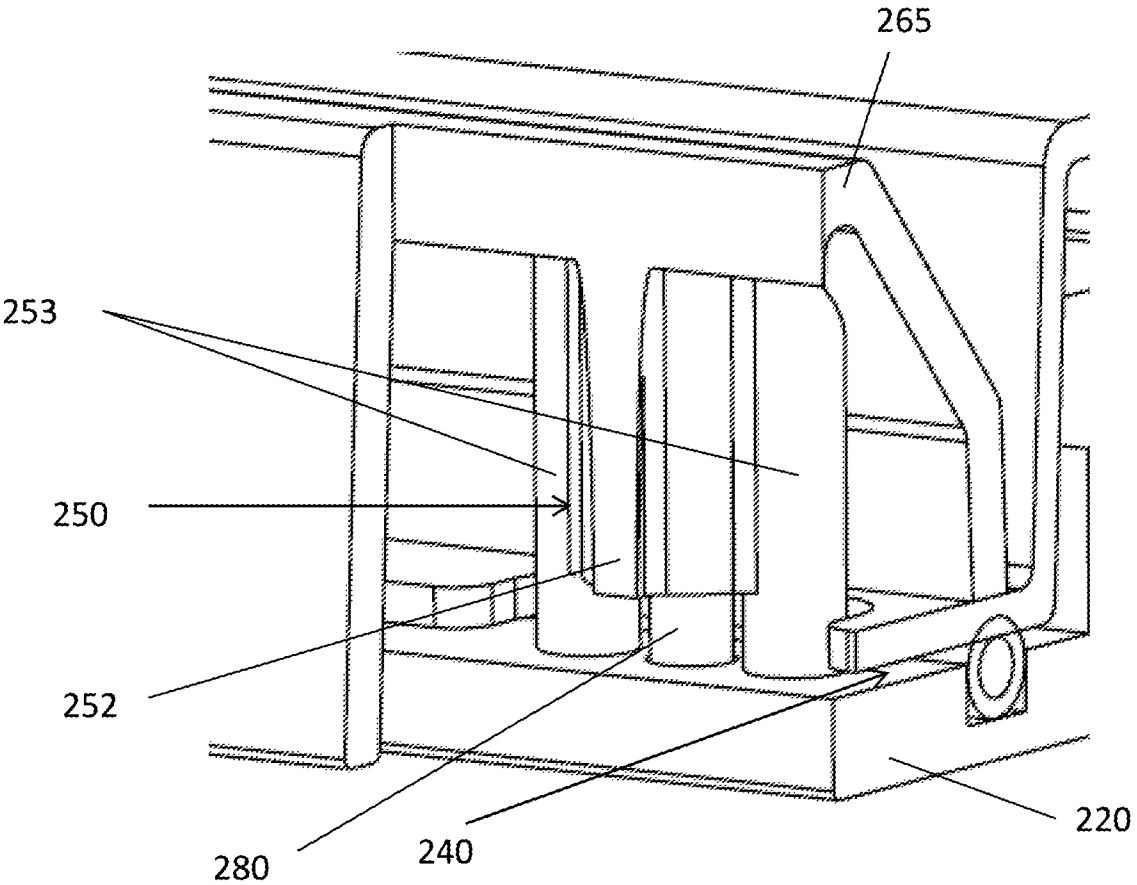
FIG. 12 illustrates a partial cut-away view of one embodiment of a frame member for a radome assembly incorporating aspects of the present disclosure.
Figure 13:
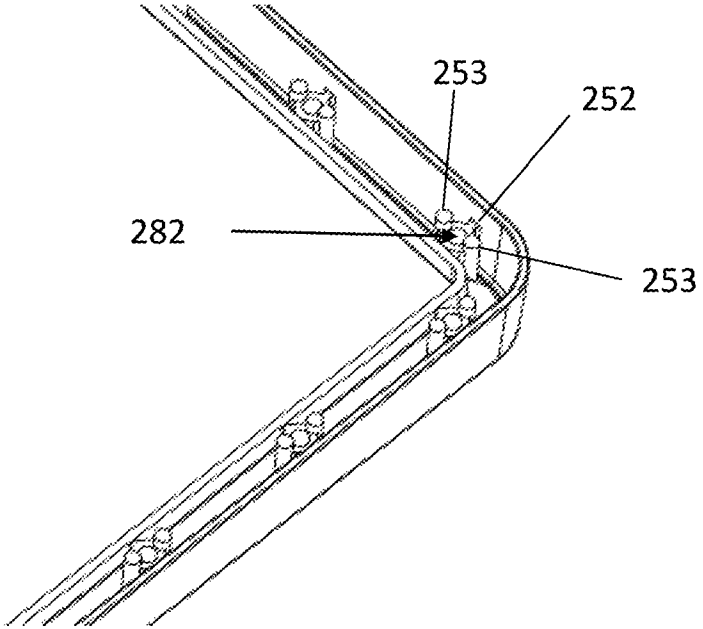
FIG. 13 illustrates a partial bottom side view of the frame member of FIG. 12.
Figure 14:
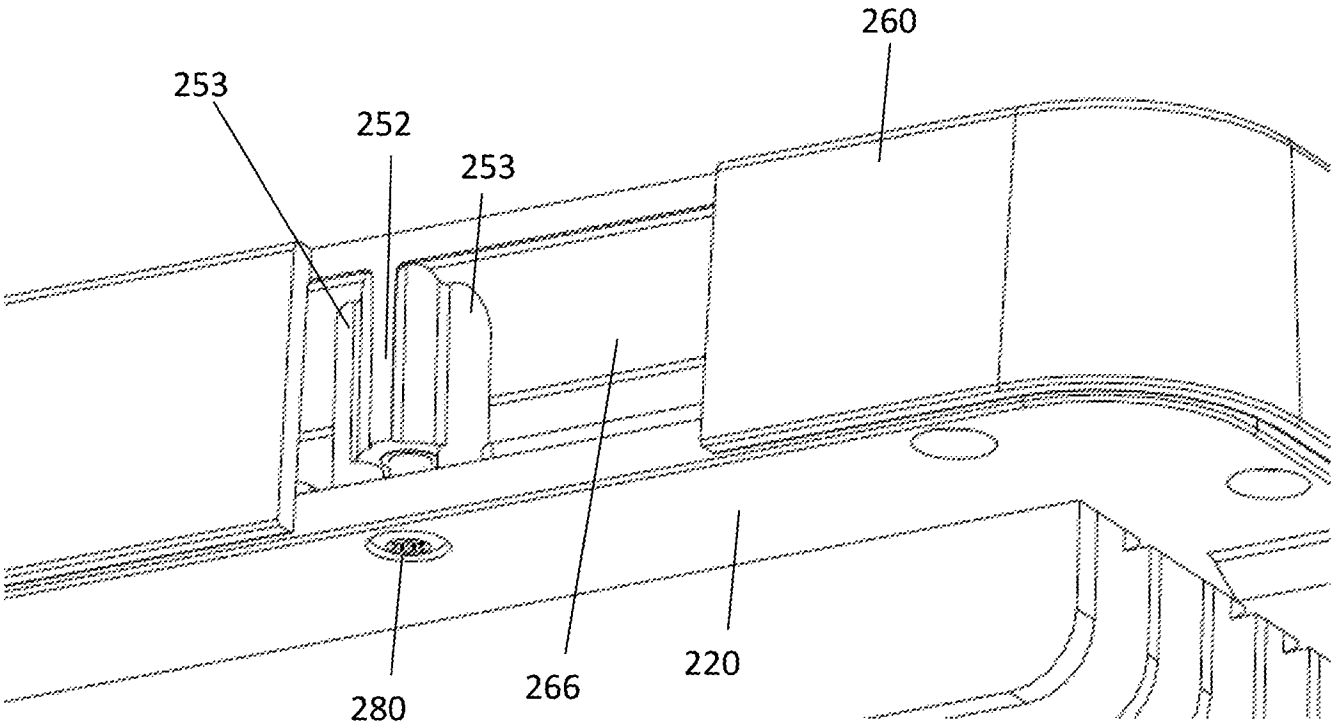
FIG. 14 illustrates a bottom side partial cut-away view of the frame member of FIG. 12.

FIGS. 12-14 illustrate an alternative embodiment of the fixation member 250. FIG. 13 illustrates a partial bottom view of the frame assembly 260 for the embodiment of FIG. 12. In this example, fixation member 250 of the frame assembly 260 includes a support sleeve 252 and one or more support pins or shoulders 253. The support sleeve 252 is disposed between or adjacent to the support pins 253. The support sleeve 252 is generally configured to receive the fastener member 280, as is illustrated in FIG. 14, for example. In one embodiment, the support sleeve 252 comprises a threaded hole and the fastener member 280 comprises a screw. During assembly, the fastener member 280 is passed through the opening 223 in the heat sink member 220 and into the threaded hole of the support sleeve 252. In alternate embodiments, the support sleeve 252 can comprise any suitable mechanism to secure the heat sink member 220 to the frame assembly 260 in the manner described herein.

Referring to FIG. 12, the support pins 253 are generally configured to be disposed within the openings or recesses 218 of the lip member 216 of the radome member 210. In this example, the support pins 253 are configured to make physical contact with the heat sink member 220. When the support pins 253 are used and there is a gap between the support sleeve 252 and the heat sink member 220, the fastener 280 will pull the support sleeve 252 towards the heat sink member 220. The pull out force must be limited to prevent damage to the threads of the support sleeve 252 when the fastener 280 is tightened. If a threaded insert 254 is used, such as the threaded insert of FIG. 6A, the pull out force must be limited to prevent the threaded insert 254 from being pulled out when the fastener member 280 is tightened.

Referring to FIGS. 12 and 13, in one embodiment, the lowermost portion of the support pins 253 is further away from a top portion 265 of the frame assembly 260 that the lowermost portion of the inner member 266. This enables the support pins 253 to make contact with the heat sink member 220, ensure that the seam member 230 is sufficiently compressed and define the gap 240 between the radome member 210 and the heat sink member 220, in the compressed state of the seal member 230. In this embodiment, the inner member 264 of the frame assembly 260 will be disposed in contact with the lip 216 of the radome member 210 to compress the seal member 230 between the radome member 210 and the heat sink member 220.

Figure 15:
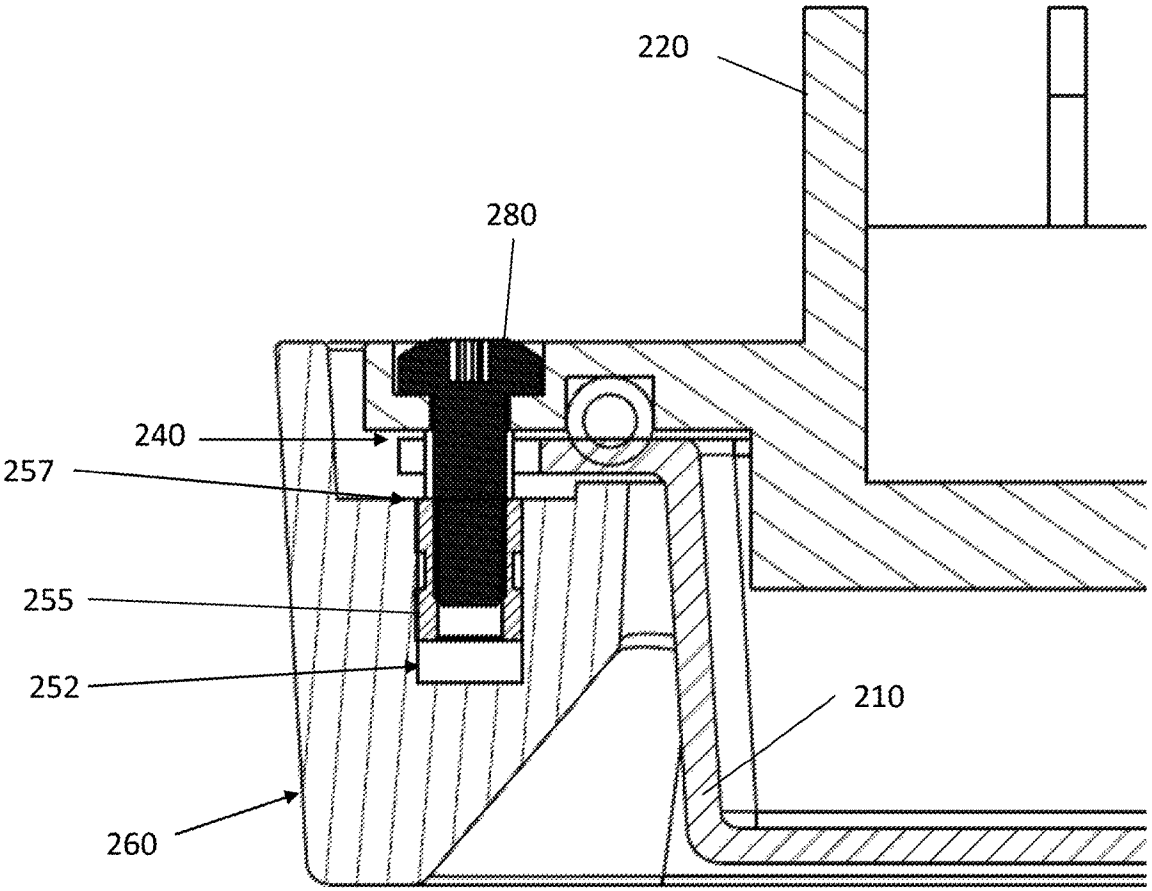
FIG. 15 illustrates a partial cross-sectional a fixation member for one embodiment of a radome assembly incorporating aspects of the present disclosure.

FIG. 15 illustrates a cross-sectional view of one embodiment of a fixation member 250 for a radome assembly incorporating aspects of the present disclosure. In this example, the fastener member 280 is inserted into the sleeve portion 252 of the fixation member 250. The sleeve portion 252 includes a threaded portion 255. This embodiment of the fixation member 250 can be used with the example shown in FIG. 12, for example, together with the support pins 253. In this example, the flange assembly 200 can be thinner than when the support is located around the threaded portion, such as shown in the example of FIGS. 4 and 6.

Figure 16:
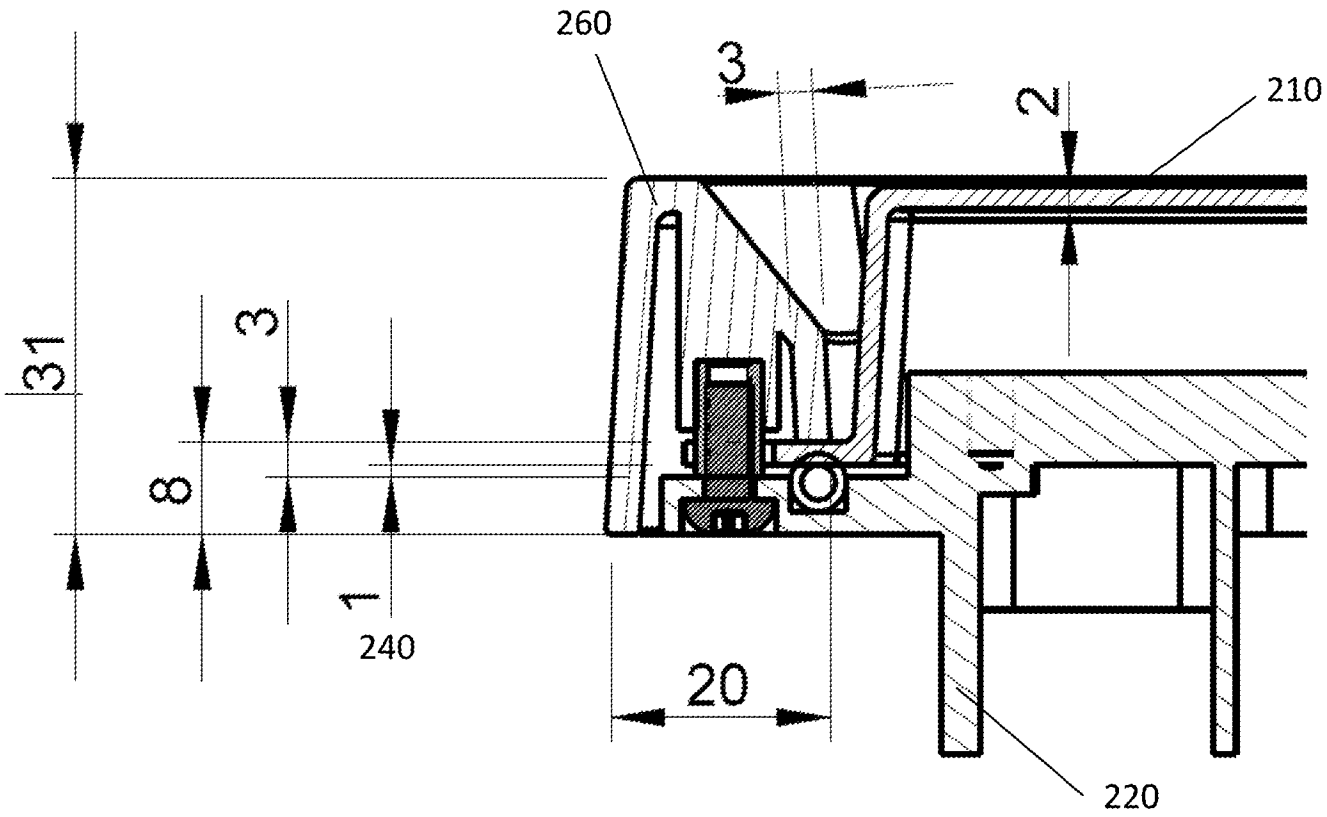
FIG. 16 illustrates exemplary dimensions for one embodiment of a radome assembly incorporating aspects of the present disclosure.

FIG. 16 illustrates exemplary dimensions for one embodiment of the radome assembly 200 incorporating aspects of the present disclosure. The dimensions noted thereon are millimeters. In this example, the dimension of the gap 240 is approximately 1 millimeter.

The aspects of the disclosed embodiments provide for a substantially flat radome industrial design for tower mounted base station antenna that is water proof. The flat surface radome design will retain its flat shape and structural integrity even during periods of thermal expansion. The use of a frame assembly to compress a seal member between the radome member and heat sink member provides a gap that provides for sideways expansion of the radome member. The frame assembly is adaptable for different design applications of various sizes, shapes and widths.

Thus, while there have been shown, described and pointed out, fundamental novel features of the invention as applied to the exemplary embodiments thereof, it will be understood that various omissions, substitutions and changes in the form and details of devices and methods illustrated, and in their operation, may be made by those skilled in the art without departing from the spirit and scope of the disclosure. Further, it is expressly intended that all combinations of those elements, which perform substantially the same function in substantially the same way to achieve the same results, are within the scope of the claims. Moreover, it should be recognized that structures and/or elements shown and/or described in connection with any disclosed form or embodiment herein may be incorporated in any other disclosed or described or suggested form or embodiment as a general matter of design choice. It is the intention, therefore, to be limited only as indicated by the scope of the claims appended hereto.

What is claimed is:

1. A radome assembly comprising,
- a radome member;
- a heat sink member;
- a seal member disposed between the radome member and the heat sink member; and
- a frame assembly configured to compress the seal member between the radome member and the heat sink member, wherein the frame assembly comprises:
  - a fixation member configured to be fixedly engaged with the heat sink member, and
  - an arm member configured to engage the radome member to compress the seal member between the radome member and the heat sink member when the fixation member is engaged with the heat sink member, and wherein engagement of the fixation member with the heat sink member in a compressed state of the seal member forms a gap between the radome member and the heat sink member.

2. The radome assembly of claim 1, wherein the radome member is disposed between the arm member of the frame assembly and the heat sink member in the compressed state of the seal member.

3. The radome assembly of claim 1, wherein the fixation member includes a threaded portion.

4. The radome assembly of claim 3, wherein the threaded portion of the fixation member comprises a threaded insert.

5. The radome assembly of claim 1, wherein a lowermost position of the fixation member relative to a lowermost position of the arm member defines a spacing of the gap between the radome member and the heat sink member in the compressed state of the seal member.

6. The radome assembly of claim 1, further comprising:
- a fastener member extending through an opening in the heat sink member and received in the fixation member to secure the frame assembly to the heat sink member and compress the seal member.

7. The radome assembly of claim 1, wherein the fixation member is disposed parallel to the arm member.

8. The radome assembly of claim 1, wherein the fixation member comprises:
- a support sleeve; and
- at least one support pin adjacent to the support sleeve, wherein the fastener member is received in the support sleeve to secure the frame assembly to the heat sink member and compress the seal member.

9. The radome assembly of claim 8, wherein the at least one support pin comprises a pair of support pins and the support sleeve is disposed between the pair of support pins.

10. The radome assembly of claim 8, wherein a lowermost position of the at least one support pin relative to a lowermost position of the arm member limits a compression of the seal member between the radome member and the heat sink member and defines a spacing of the gap between the radome member and the heat sink member.

11. The radome assembly of claim 1, wherein the radome member comprises:

a lip member for compressing the seal member against the heat sink member.

12. The radome assembly of claim 11, wherein the lip member is disposed parallel to the radome member.

13. The radome assembly of claim 1, wherein the heat sink member comprises:

a channel member, and wherein the seal member being at least partially received in the channel member.

14. The radome assembly of claim 1, wherein the radome member does not contact the heat sink member in the compressed state of the seal member.

15. The radome assembly of claim 1 wherein the gap between the radome member and the heat sink member accommodates thermal expansion of the radome member relative to the heat sink member to maintain a form of the radome member.

* * * * *